US008095040B2

(12) United States Patent
Tomita et al.

(10) Patent No.: US 8,095,040 B2
(45) Date of Patent: Jan. 10, 2012

(54) INTERMEDIATE TRANSFER-TYPE IMAGE FORMING APPARATUS WITH SEPARATION/CONTACT MECHANISM

(75) Inventors: Norio Tomita, Nara (JP); Hiroshi Tachiki, Nara (JP); Takahiko Yoshida, Nara (JP); Yoshikazu Harada, Nara (JP); Yoshiteru Kikuchi, Nara (JP); Kenichi Isomi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 511 days.

(21) Appl. No.: 12/334,626

(22) Filed: Dec. 15, 2008

(65) Prior Publication Data

US 2009/0154945 A1 Jun. 18, 2009

(30) Foreign Application Priority Data

Dec. 17, 2007 (JP) ..... 2007-325092

(51) Int. Cl.
*G03G 15/08* (2006.01)
*G03G 15/10* (2006.01)

(52) U.S. Cl. ..... 399/121; 399/49; 399/64; 399/74; 399/101

(58) Field of Classification Search ..... 399/49, 399/64, 121, 101, 74
See application file for complete search history.

(56) References Cited

U.S. PATENT DOCUMENTS

| | | | | |
|---|---|---|---|---|
| 7,877,031 | B2 * | 1/2011 | Fukushi | 399/64 |
| 2008/0145089 | A1 * | 6/2008 | Takahashi | 399/74 |
| 2009/0003877 | A1 * | 1/2009 | Miura | 399/121 |
| 2009/0180803 | A1 * | 7/2009 | Tomita et al. | 399/121 |
| 2010/0014878 | A1 * | 1/2010 | Tomita | 399/49 |
| 2011/0026953 | A1 * | 2/2011 | Tomita | 399/44 |
| 2011/0052239 | A1 * | 3/2011 | Tanaka et al. | 399/74 |

FOREIGN PATENT DOCUMENTS

| | | | | |
|---|---|---|---|---|
| CN | 101334604 | A | | 12/2000 |
| JP | 04-190255 | | | 7/1992 |
| JP | 07-234595 | | | 9/1995 |
| JP | 2003195578 | A | * | 7/2003 |
| JP | 2004-101687 | | | 4/2004 |
| JP | 2004101687 | A | * | 4/2004 |
| JP | 2005070676 | A | * | 3/2005 |
| JP | 2006-003399 | | | 1/2006 |
| JP | 2007272154 | A | * | 10/2007 |

* cited by examiner

*Primary Examiner* — David Gray
*Assistant Examiner* — G. M. Hyder
(74) *Attorney, Agent, or Firm* — Renner, Otto, Boisselle & Sklar, LLP

(57) ABSTRACT

In an embodiment of the present invention, an image forming apparatus includes a transfer belt that primarily transfers a toner image formed on a photosensitive drum; a secondary transfer unit including a transfer mechanism portion that secondarily transfers the primarily transferred toner image to a paper; an optical sensor that detects a reference toner image on the transfer belt; and a shutter that protects a detection face of the optical sensor, wherein a separation/contact mechanism portion disposed so as to be brought into contact with both of the shutter and the secondary transfer unit is provided, and the separation/contact mechanism portion allows the shutter to move so as to open and allows the secondary transfer unit to move so as to separate from the transfer belt when the reference toner image is detected by the optical sensor, and allows the shutter to move so as to separate from the transfer belt when the secondary transfer unit is drawn out from an apparatus main body.

9 Claims, 9 Drawing Sheets

INTERMEDIATE TRANSFER-TYPE IMAGE FORMING APPARATUS WITH SEPARATION/CONTACT MECHANISM

BACKGROUND OF THE INVENTION

This application claims priority under 35 U.S.C. §119(a) on Patent Application No. 2007-325092 filed in Japan on Dec. 17, 2007, the entire contents of which are hereby incorporated by reference.

The present invention relates to an intermediate transfer-type image forming apparatus provided with a transfer belt that primarily transfers a toner image formed on a photosensitive drum, a secondary transfer unit having a transfer roller that secondarily transfers the primarily transferred toner image to a paper, and an optical sensor that detects a reference toner image on the transfer belt.

Recently, electrophotographic image forming apparatuses that are capable of forming a multicolor image, for example, a color copier and a color printer, have been developed. For example, in a well-known intermediate transfer-type image forming apparatus, an image is formed by forming a toner image for each color on a latent image carrier such as a photosensitive drum; forming a multicolor image by transferring the toner image for each color one-by-one in overlaying fashion to a transfer belt, i.e., an intermediate transfer body; and transferring the multicolor image to a recording paper, i.e., a transfer paper, and then fixing the multicolor image to the recording paper.

An example of such an image forming apparatus includes an image forming apparatus including a transfer belt that primarily transfers a toner image formed on a photosensitive drum, a secondary transfer unit having a transfer roller that secondarily transfers the primarily transferred toner image to a paper, an optical sensor that detects a reference toner image on the transfer belt, and a shutter that protects a detection face of the optical sensor, and structured so that the secondary transfer unit and the shutter are coordinated (for example, see JP H7-234595A).

Although the image forming apparatus described in JP H7-234595A is not an intermediate transfer-type, as shown in FIG. 9, the apparatus is structured so that a shutter 517 and a transfer roller (corresponding to the secondary transfer unit) 505 are coordinated by a disjunction means. That is, before a reference toner image 506 on a photosensitive drum 501 reaches a position at which the reference toner image 506 is brought into contact with the transfer roller 505, a solenoid 512 is energized. In this way, an actuator 512*a* is pulled in by the solenoid 512, and along with that, an arm member 509 rotates in the clockwise direction around a spindle 510, the transfer roller 505 attached to one end of the arm member 509 moves from the position where it is in contact with the surface of the photosensitive drum 501 to a position where it is separated from that surface, indicated by reference numeral 505'. Also, along with the rotation of the arm member 509, a shutter arm member 516 that is linked to the arm member 509 also rotates in the clockwise direction around the spindle 510, and the shutter 517 moves along a guide member in the direction of the arrow, from a protection position to an evacuated position, evacuating so that a reflective optical sensor 507 can detect optical density of a reference toner image 506'.

Then, after the reference toner image on the photosensitive drum 501 has passed through the position where it faces the transfer roller 505 and the reflective optical sensor 507 has detected the optical density, the solenoid 512 is de-energized. In this way, the arm member 509 and the shutter arm member 516 rotate in the counter-clockwise direction around the spindle 510 due to biasing force of a spring 511; the transfer roller 505 is brought into contact with the surface of the photosensitive drum 501 with a predetermined pressure, to be standing by for a next transfer operation; and the shutter 517 moves to the protection position. In FIG. 9, reference numeral 541 indicates a developer sleeve, and 545 indicates a developer bias power source.

As described above, in conventional image forming apparatuses, the shutter 517 that opens and closes so as to protect a detection face of the reflective optical sensor 507 is provided, and at the time of the density measurement, this shutter 517 is opened, and it is necessary that the transfer roller (secondary transfer unit in the case of intermediate transfer-type) 505 for transferring a toner image on the photosensitive drum (transfer belt in the case of intermediate transfer-type) 501 to a paper is separated from the photosensitive drum (transfer belt in the case of intermediate transfer-type) 501.

Furthermore, when such a shutter 517 is provided, it is conceivable that a controlling means controls a driving current using reflected light between facing planes of the shutter 517 and the reflective optical sensor 507 when the shutter is closed as a reference reflected light, in order to adjust the driving current of the reflective optical sensor 507 to adjust the irradiation light amount to a constant amount. Therefore, it is necessary that the shutter 517 is provided in proximity to the photosensitive drum (transfer belt in the case of intermediate transfer-type) 501. This is because, since outgoing light from the reflective optical sensor 507 is applied to the surface of the photosensitive drum (transfer belt in the case of intermediate transfer-type) 501, and its reflected light is detected by the detection face of a photo transistor, when the surface of the photosensitive drum (transfer belt in the case of intermediate transfer-type) 501 and the shutter 517 are not close to each other, there is a possibility that the reference reflected light from the shutter 517 will not reach the photo transistor.

As described above, it is necessary that the shutter 517 is disposed near the photosensitive drum (transfer belt in the case of intermediate transfer-type) 501. Therefore, in intermediate transfer-type image forming apparatuses, when attaching or removing the transfer belt, there is a risk that the shutter is brought in contact with the surface of the transfer belt, damaging the surface of the transfer belt. Thus, when attaching or removing the transfer belt to or from the main body of the apparatus, it is necessary to separate the shutter from the transfer belt, but no proposal has been made to configure conventional intermediate transfer-type image forming apparatuses so that the shutter is separated from the transfer belt when attaching or removing the transfer belt to or from the main body of the apparatus.

SUMMARY OF THE INVENTION

The present invention has been devised in light of these circumstances and it is an object thereof to provide an intermediate transfer-type image forming apparatus in which opening and closing operation of a shutter, separation operation of a transfer belt and a secondary transfer unit, and separation operation of the shutter at the time of attachment and detachment of the transfer belt can be carried out in a coordinated series, and such a coordinated operation is realized with a mechanical structure that is simpler and has fewer components.

To solve the above-described problems, an image forming apparatus of the present invention includes, a transfer belt that primarily transfers a toner image formed on a photosensitive drum; a secondary transfer unit having a transfer mechanism portion that secondarily transfers the primarily transferred toner image to a paper; an optical sensor that detects a reference toner image on the transfer belt; and a shutter that protects a detection face of the optical sensor, wherein a separation/contact mechanism portion that is disposed so as to be brought into contact with both of the shutter and the secondary transfer unit is provided, and the separation/contact mechanism portion allows the shutter to move so as to open and allows the secondary transfer unit to move so as to separate from the transfer belt when the reference toner image is detected by the optical sensor, and allows the shutter to move so as to separate from the transfer belt when the secondary transfer unit is drawn out from an apparatus main body. To be more specific, the separation/contact mechanism portion is configured to include an eccentric cam provided with a cam face that is brought into contact with both of the shutter and the secondary transfer unit.

That is, based on rotation of the eccentric cam, the shutter and the secondary transfer unit that are in contact with the cam face are allowed to move in coordination. In this case, the separation/contact mechanism portion includes a shutter bias portion that biases the shutter in a direction that the shutter opens; and a unit bias portion that biases a transfer roller in a direction that the transfer roller is pressed against the transfer belt. Thus, the shutter repeats opening and closing operation by rotation of the eccentric cam, and the secondary transfer unit repeats pressing against and separating from the transfer belt.

The secondary transfer unit and the eccentric cam are provided at a side unit provided slidably with respect to the apparatus main body, and when the side unit is drawn out from the apparatus main body, the contact between the eccentric cam and the shutter is released. Therefore, when the side unit is drawn out from the apparatus main body, the shutter moves in a direction that the shutter opens by the shutter bias portion, thereby separating from the transfer belt surface. In this case, when the shutter opens by the shutter bias portion without limit, the cam face of the eccentric cam and the shutter may possibly fail to be brought into contact well when the side unit is attached to the apparatus main body again. Thus, in the present invention, a configuration including a regulating portion that regulates the movement of the shutter by the shutter bias portion to a predetermined distance when the secondary transfer unit (side unit) is drawn out from the apparatus main body is used. Thus, even if the contact between the shutter and the eccentric cam is released when the side unit is drawn out from the apparatus main body, because the shutter stops after moving the predetermined distance, the cam face of the eccentric cam and the shutter can be brought into contact reliably when the side unit is attached to the apparatus main body again.

Furthermore, in the image forming apparatus of the present invention, the optical sensor is a reflective optical sensor including a light-emitting element and a light-receiving element, and is provided with a control unit that carries out a light amount adjustment based on a light receiving amount obtained by allowing the light-emitting element to emit light while the shutter is protecting the detection face of the optical sensor and receiving reflected light at a reverse side of the shutter by the light-receiving element. That is, by using the shutter as a substrate for a light amount adjustment as well, it is not necessary to provide a member specialized for the light amount adjustment, achieving a simple structure.

In this case, the shutter is preferably provided in a close proximity to the transfer belt when the shutter is closed so as to protect the detection face of the optical sensor. By providing the shutter in close proximity to the transfer belt, a light amount to the transfer belt can be adjusted more accurately.

Furthermore, in the image forming apparatus of the present invention, a configuration can be made so as to detect the movement of the secondary transfer unit by using output of the optical sensor. In this case, the optical sensor uses a sensor that detects specularly reflected light. The shutter is also configured so as not to reflect light. In this way, as long as the shutter is closed, there is no specularly reflected light to the optical sensor, and as long as the shutter is opened, specularly reflected light from the transfer belt reaches the light-receiving portion of the optical sensor. Therefore, it is possible to detect and check by using output of the optical sensor, whether or not the shutter is reliably opened and closed in coordination when the shutter is opened and closed by moving the separation/contact mechanism portion.

Furthermore, in a configuration of the image forming apparatus of the present invention, registration sensors for detecting a registration mark of a reference pattern may be disposed in a row with the optical sensor along a main scanning direction, and opening and closing of the registration sensors and the optical sensor may be commonly controlled by the shutter. By commonly using the shutter, the structure surrounding the transfer belt can be made simple.

The present invention is configured as described above, and therefore opening and closing operation of the shutter, separation operation of the transfer belt and the secondary transfer unit, and separation operation of the shutter at the time of attachment and detachment of the transfer belt can be carried out in a coordinated series, and these coordinated operations can be realized with a mechanical structure that is simpler and has fewer components.

DESCRIPTION OF THE PREFERRED EMBODIMENTS

In the following, an image forming apparatus according to an embodiment of the present invention is described with reference to the drawings.

Figure 1:
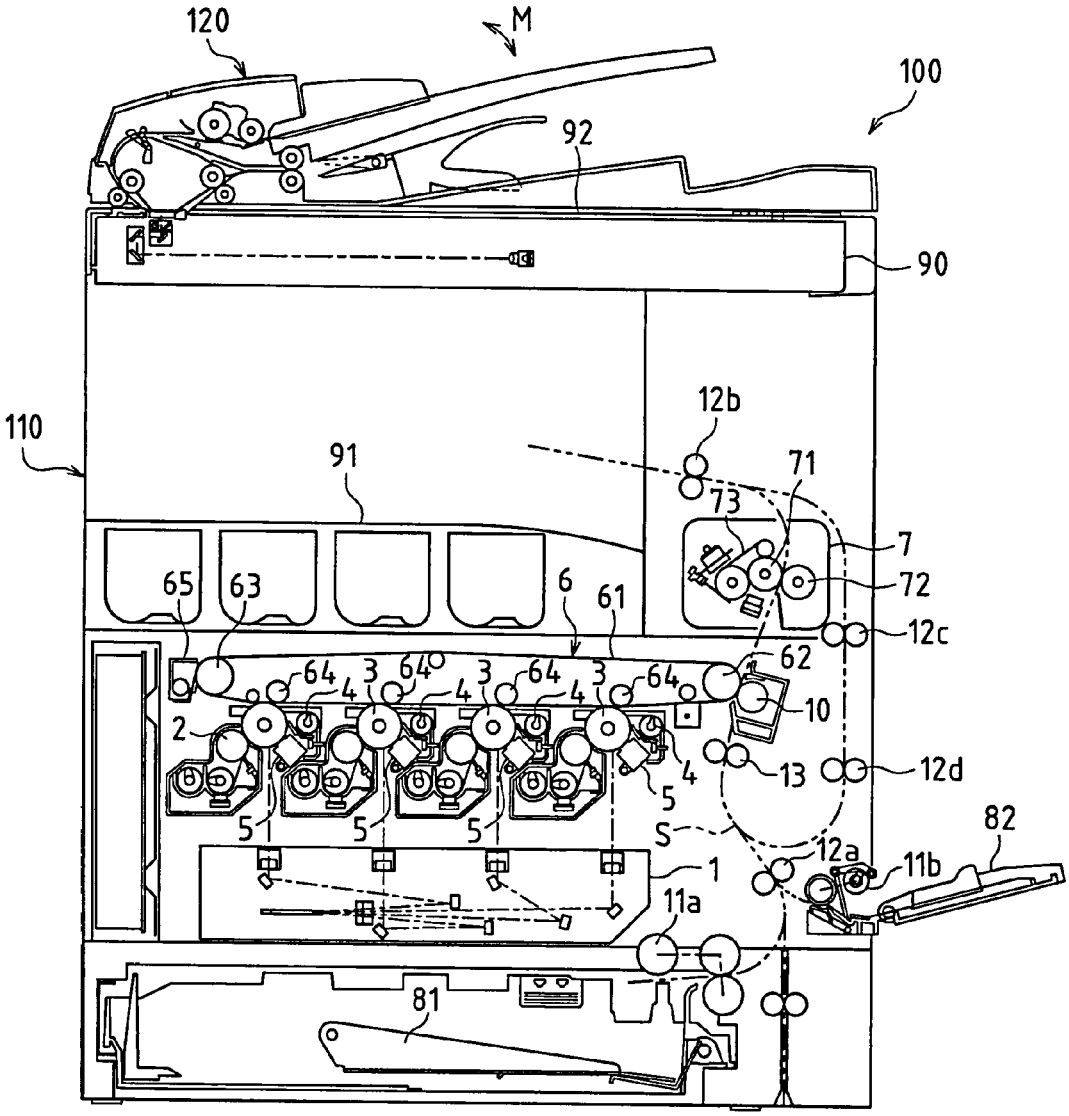
FIG. 1 is a side view illustrating the overall configuration of an image forming apparatus of the present invention.

FIG. 1 is a side view illustrating the overall configuration of an image forming apparatus according to this embodiment.

An image forming apparatus 100 of this embodiment forms a multicolor or single color image according to image data transmitted from outside on a predetermined sheet (recording paper), and is configured of an apparatus main body 110 and an automatic document feeder 120.

The apparatus main body 110 is configured having, for example, an exposure unit 1, a development unit 2, a photosensitive drum 3, a cleaner unit 4, a charging unit 5, an intermediate transfer belt unit 6, a fixing unit 7, a paper cassette 81, and a discharge tray 91.

On top of the apparatus main body 110, an original placement stage 92 made of transparent glass where an original is placed is provided, and the automatic document feeder 120 is attached to the top side of the original placement stage 92. The automatic document feeder 120 automatically transports an original onto the original placement stage 92. Also, the original processing apparatus 120 is configured so that the original processing apparatus 120 is swingable in the direction of arrow M and an original can be manually placed by opening the top of the original placement stage 92.

Image data processed in the image forming apparatus 100 is based on color images employing black (K), cyan (C), magenta (M), and yellow (Y). Therefore, four each of the development unit 2, the photosensitive drum 3, the charging unit 5, and the cleaner unit 4 are provided that correspond to the respective colors so as to form four latent images for the colors black, cyan, magenta, and yellow, thereby forming four image stations.

The charging unit 5 is a charging means for charging the surface of the photosensitive drum 3 uniformly to a predetermined potential, and other than the charger type shown in FIG. 1, a charging unit of a contact type such as a roller type or a brush type is sometimes used.

The exposure unit 1 is configured as a laser scanning unit (LSU) provided with, for example, a laser irradiation unit and a reflecting mirror. In the exposure unit 1, optical elements such as a polygon mirror that scans a laser beam, and lenses and mirrors for guiding the laser light reflected by the polygon mirror to the photosensitive drum 3 are disposed. It should be noted that, for example, an EL or LED writing head in which light-emitting elements are arranged in an array may also be used as the exposure unit 1.

The exposure unit 1 has a function of forming electrostatic latent images on the surface of the photosensitive drums 3 according to input image data by exposing the charged photosensitive drums 3 according to the image data. The development units 2 use toner of four colors (Y, M, C, and K) to turn the electrostatic latent images formed on the respective photosensitive drums 3 into manifest images. The cleaner units 4 remove and collect toner that is residual on the surface of the photosensitive drums 3 after development and transfer of images.

The intermediate transfer belt unit 6 disposed above the photosensitive drums 3 is provided with an intermediate transfer belt 61, an intermediate transfer belt driving roller 62, an intermediate transfer belt idler roller 63, an intermediate transfer roller 64, and an intermediate transfer belt cleaning unit 65. Four intermediate transfer rollers 64 are provided for respective colors of Y, M, C, and K.

The intermediate transfer belt 61 is stretched across and supported by the intermediate transfer belt drive roller 62, the intermediate transfer belt idler roller 63, and the intermediate transfer rollers 64, which allow the intermediate transfer belt 61 to rotate. Each of the intermediate transfer rollers 64 provides a transfer bias for transferring the toner images on the photosensitive drums 3 onto the intermediate transfer belt 61.

The intermediate transfer belt 61 is provided so as to make contact with the respective photosensitive drums 3, and functions such that the toner images of each color formed on the photosensitive drums 3 are superimposed and transferred sequentially on the intermediate transfer belt 61, so that color toner images (multicolor toner images) are formed on the intermediate transfer belt 61. This intermediate transfer belt 61 is formed so as to have no end, using a film having a thickness of about 100 μm to 150 μm.

The transfer of the toner image from the photosensitive drums 3 to the intermediate transfer belt 61 is performed by the intermediate transfer rollers 64 that are in contact with the reverse side of the intermediate transfer belt 61. A high voltage transfer bias (high voltage of a polarity (+) that is opposite to the polarity (−) of charged toner) is applied to the intermediate transfer rollers 64 for transferring the toner images. The intermediate transfer rollers 64 are rollers that are based on a metal (for example, stainless steel) shaft having a diameter of 8 to 10 mm and whose surface is covered with a conductive elastic material (for example, EPDM, urethane foam, etc.). This conductive elastic material allows a high voltage to be applied uniformly to the intermediate transfer belt 61. In this embodiment, a roller-shaped transfer electrode is used, but a brush also can be used.

The electrostatic images that have been turned visible in accordance with each hue on the respective photosensitive drums 3 as described above are laminated on the intermediate transfer belt 61. Thus laminated image information is transferred on a paper by a transfer roller 10 arranged in the contact positions of the intermediate transfer belt 61 and the paper, which will be described later, by the rotation of the intermediate transfer belt 61, i.e., a secondary transfer mechanism unit. However, the secondary transfer mechanism unit is not limited to the transfer roller, and a corona charger or a transfer belt can also be used.

At this time, the intermediate transfer belt 61 and the transfer roller 10 are pressed so as to be in contact with each other with a predetermined nip, and a voltage (high voltage of polarity (+) opposite to polarity (−) of charged toner) is applied to the transfer roller 10 to transfer the toner onto a paper. Furthermore, in order for the transfer roller 10 to obtain the nip constantly, either one of the transfer roller 10 and the intermediate transfer belt driving roller 62 is made of a hard material (metal or the like), and the other is made of a soft material, such as an elastic roller (elastic rubber roller, foam resin roller or the like).

Furthermore, as described above, toner attached to the intermediate transfer belt 61 by the contact with the photosensitive drums 3 or toner that is left on the intermediate transfer belt 61 instead of being transferred onto a paper by the transfer roller 10 may cause colors to be mixed in the following process, and therefore the system is configured such that the toner is removed and collected by the intermediate transfer belt cleaning unit 65. This intermediate transfer belt cleaning unit 65 is provided with, for example, a cleaning blade as a cleaning member that is in contact with the intermediate transfer belt 61, and the intermediate transfer belt 61 that is in contact with the cleaning blade is supported by the intermediate transfer belt idler roller 63 from the back side.

The paper cassette 81 is a tray for accommodating sheets (recording paper) used for image formation, and is provided in the lower portion of the exposure unit 1 of the apparatus main body 110. The sheet used for the image forming may also be placed in a manual paper cassette 82. The discharge tray 91 provided in an upper portion of the apparatus main body 110 is a tray on which printed sheets are to be accumulated facedown.

In the apparatus main body 110, a substantially vertical paper transporting path S for conveying the sheets in the paper cassette 81 and the manual paper cassette 82 to the discharge tray 91 through the transfer roller 10 and the fixing unit 7 is provided. In the proximity of the paper transporting path S from the paper cassette 81 or the manual paper cassette 82 toward the discharge tray 91, pickup rollers 11*a* and 11*b*, a plurality of transport rollers 12*a* to 12*d*, a registration roller 13, the transfer roller 10, the fixing unit 7, and the like are disposed.

The transport rollers 12*a* to 12*d* are small rollers for promoting or helping transportation of the sheet, and a plurality of transport rollers are provided along the paper transporting path S. A pickup roller 11*a* is provided in the proximity of the end portion of the paper cassette 81, and picks up and supplies sheets one-by-one from the paper cassette 81 to the paper transporting path S. Similarly, a pickup roller 11*b* is provided in the proximity of the end portion of the manual paper cassette 82, and picks up and supplies sheets one-by-one from the manual paper cassette 82 to the paper transporting path S.

Furthermore, temporarily holds the registration roller 13 the sheet that is being transported on the paper transporting path S, and has a function to transport the sheet to the transfer roller 10 at a timing at which the edge of the toner image on the photosensitive drum 3 is matched with the edge of the sheet.

The fixing unit 7 is provided with a heat roller 71 and a pressing roller 72, and the heat roller 71 and the pressing roller 72 are configured so as to be rotated with the sheet sandwiched therebetween. The heat roller 71 is set to be a predetermined fixing temperature by a controller based on signals from a temperature detector (not shown), and has a function to melt, mix, and press multicolor toner images transferred onto the sheet so that the images are thermally fixed onto the sheet by subjecting the sheet to thermocompressing bonding in cooperation with the pressing roller 72. Furthermore, an external heating belt 73 for heating the heat roller 71 from outside is provided.

Next, the sheet transporting path will be described more specifically.

As described above, in the image forming apparatus 100, the paper cassette 81 and the manual paper cassette 82 for accommodating sheets in advance are provided. The pickup rollers 11*a* and 11*b* are disposed for feeding sheets from these paper cassettes 81 and 82, and are configured to guide sheets one-by-one to the transporting path S.

A sheet transported from the paper cassettes 81 and 82 is transported to the registration roller 13 by the transport roller 12*a* of the paper transporting path S, and is transported to the transfer roller 10 at a timing at which the edge of the sheet is matched with the edge of the image information on the intermediate transfer belt 61, and then the image information is written on the sheet. Thereafter, the sheet passes through the fixing unit 7 so that unfixed toner on the sheet is melted and attached firmly to the sheet by heat and passes through the transport roller 12*b* and is discharged onto the discharge tray 91.

The above-described transporting path is used for when the requested printing is simplex printing. In contrast, when the requested printing is duplex printing, the rear end of the sheet that has passed through the fixing unit 7 after the simplex printing as described above is completed is chucked by the last transport roller 12*b*, and the transport roller 12*b* rotates in the reverse direction to guide the sheet to the transport rollers 12*c* and 12*d*. Thereafter, the sheet passes through the registration roller 13, is printed on its back face, and then is discharged to the discharge tray 91.

The overall configuration of an image forming apparatus is described above. In the following, a characteristic portion of the present invention is described.

Figure 2:
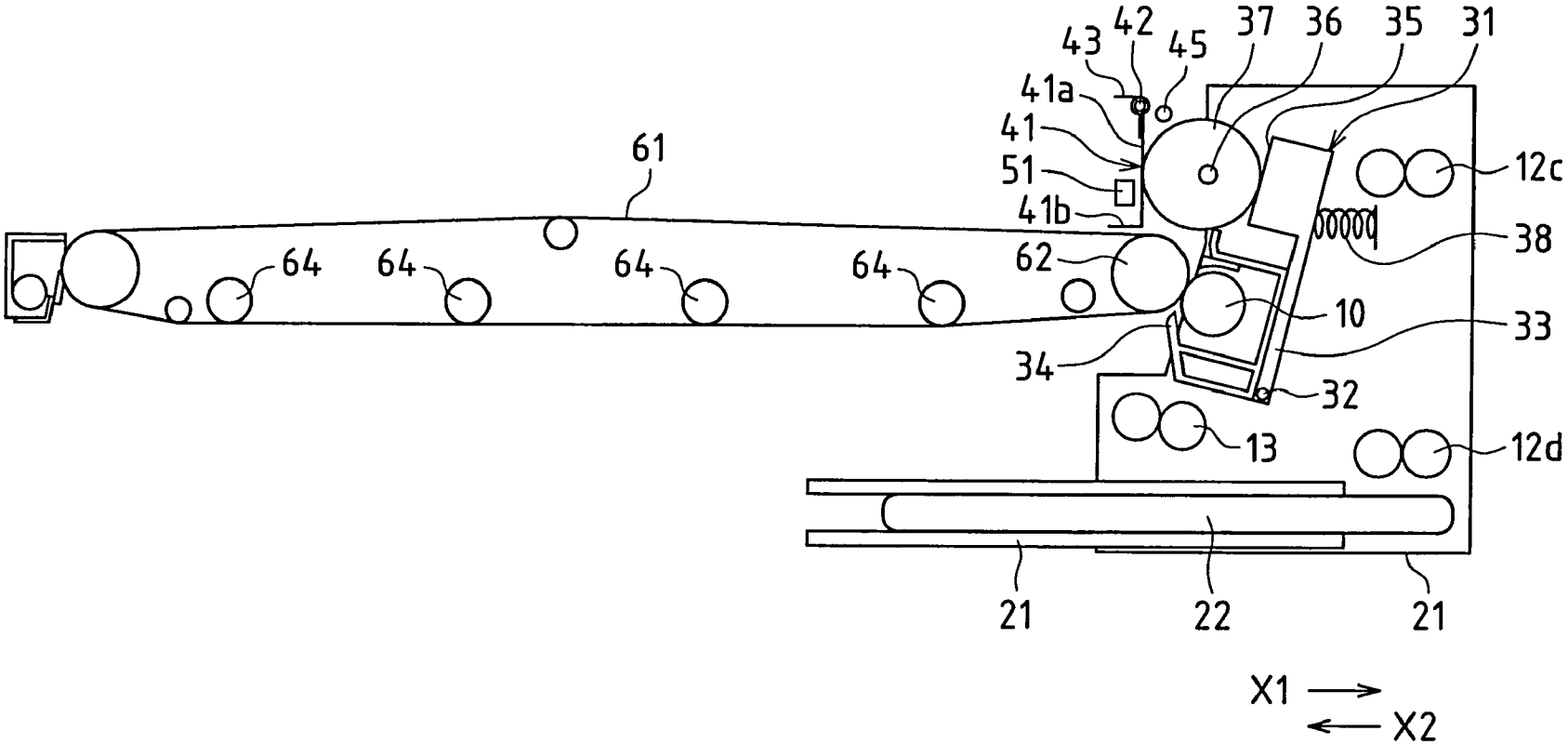
FIG. 2 is a side view illustrating the structure in the vicinity of an intermediate transfer belt unit that is a characteristic portion of the present invention.
Figure 3:
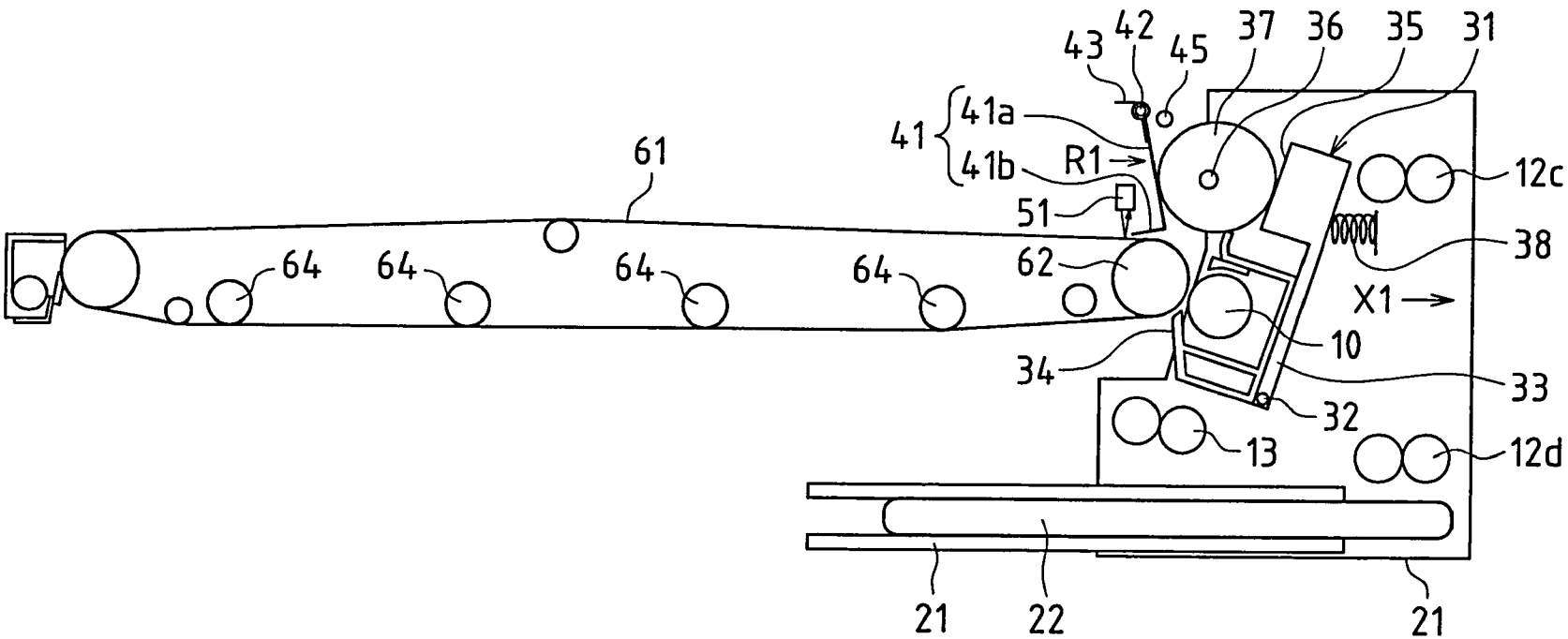
FIG. 3 is a side view illustrating the structure in the vicinity of an intermediate transfer belt unit that is a characteristic portion of the present invention.

FIG. 2 and FIG. 3 illustrate mechanical structures surrounding the intermediate transfer belt unit 6, a characteristic portion of the present invention.

In this embodiment, a secondary transfer unit 31 including the transfer roller 10 is attached in a side unit 21 disposed at the side of the intermediate transfer belt drive roller 62 of the intermediate transfer belt 61.

The side unit 21 is provided so as to slide, being drawable (in the direction of arrow X1 in the figures) and attachable (in the direction of arrow X2 in the figures) with respect to the apparatus main body 110 by guardrails 22 and 23 provided to an apparatus frame (not shown).

The secondary transfer unit 31 is provided with a rotating plate 33 that is attached swingably with respect to the side unit 21 by a supporting shaft 32 at a lower end of the rotating plate 33, and a roller case 34 that holds the transfer roller 10 rotatably is fixed at a lower side of the rotating plate 33. That is, by the rotational movement of the rotating plate 33 around the supporting shaft 32, the transfer roller 10 can be brought into contact with and can be separated from the intermediate transfer belt 61 that is wound by the intermediate transfer belt drive roller 62.

On the other hand, the upper side of the rotating plate 33 is a cam contact face 35 that is protruding toward the intermediate transfer belt unit 6 so as to be brought into contact with a cam face of an eccentric cam 37 held rotatably by a cam shaft 36 at an end of the side unit 21 at the side of the intermediate transfer belt unit 6. Furthermore, an elastic member 38 such as a coil spring for biasing the cam contact face 35 to achieve contact with a cam face of the eccentric cam 37 is interposed between the plane opposite to the cam contact face 35 and the side unit 21. This elastic member 38 allows the cam contact face 35 of the rotating plate 33 to constantly make contact (press contact) with a cam face of the eccentric cam 37.

Furthermore, the transfer roller 10 is disposed so as to make contact with the intermediate transfer belt 61 with a predetermined nip pressure in a state where the cam contact face 35 is in contact with a cam face where the distance from the cam center of the eccentric cam 37 is the shortest (a state as shown in FIG. 2). Meanwhile, the transfer roller 10 is separated from the intermediate transfer belt 61 in a state where the cam contact face 35 is in contact with a cam face where the distance from the cam center of the eccentric cam 37 is the furthest (a state as shown in FIG. 3).

On the other hand, an L-shaped shutter 41 is disposed at a position opposing the cam contact face 35 of the rotating plate 33 with the eccentric cam 37 interposed therebetween, so that a vertical face 41*a* of the shutter 41 is brought into contact with the eccentric cam 37. The shutter 41 is supported by the apparatus frame (not shown) via a shutter supporting shaft 42 at an upper end portion of the vertical face 41*a* so as to be swingable, and a horizontal face 41*b* at a lower end that is bent to form an L-shape is disposed so as to face the optical sensor 51 that is disposed so as to vertically oppose the intermediate transfer belt 61 while keeping a certain distance between the optical sensor 51 and the intermediate transfer belt 61. That is, the horizontal face 41*b* of the shutter 41 is disposed so as to be positioned between the optical sensor 51 and the intermediate transfer belt 61, and the horizontal face 41*b* is disposed so as to be closer to the intermediate transfer belt 61.

A torsion coil spring 43 is attached to the shutter supporting shaft 42 of the shutter 41 disposed in such a fashion. One end of the torsion coil spring 43 is fixed to the apparatus frame, and the other end of the torsion coil spring 43 is in contact with the vertical face 41*a*, so as to bias the vertical face 41*a* toward the side of the cam face of the eccentric cam 37.

Furthermore, the horizontal face 41*b* is inserted between the optical sensor 51 and the intermediate transfer belt 61 to protect a detection face of the optical sensor 51 (that is, to close the shutter) in a state where the vertical face 41*a* is in contact with a cam face where the distance from the cam center of the eccentric cam 37 is the furthest (a state as shown in FIG. 2). When in a state where the vertical face 41*a* is in contact with a cam face where the distance from the cam center of the eccentric cam 37 is the nearest (a state as shown in FIG. 3), the horizontal face 41*b* swings toward the side unit 21 by the amount of eccentricity of the eccentric cam 37, so as to evacuate from the detection face of the optical sensor 51 (that is, to open the shutter).

Figure 4:
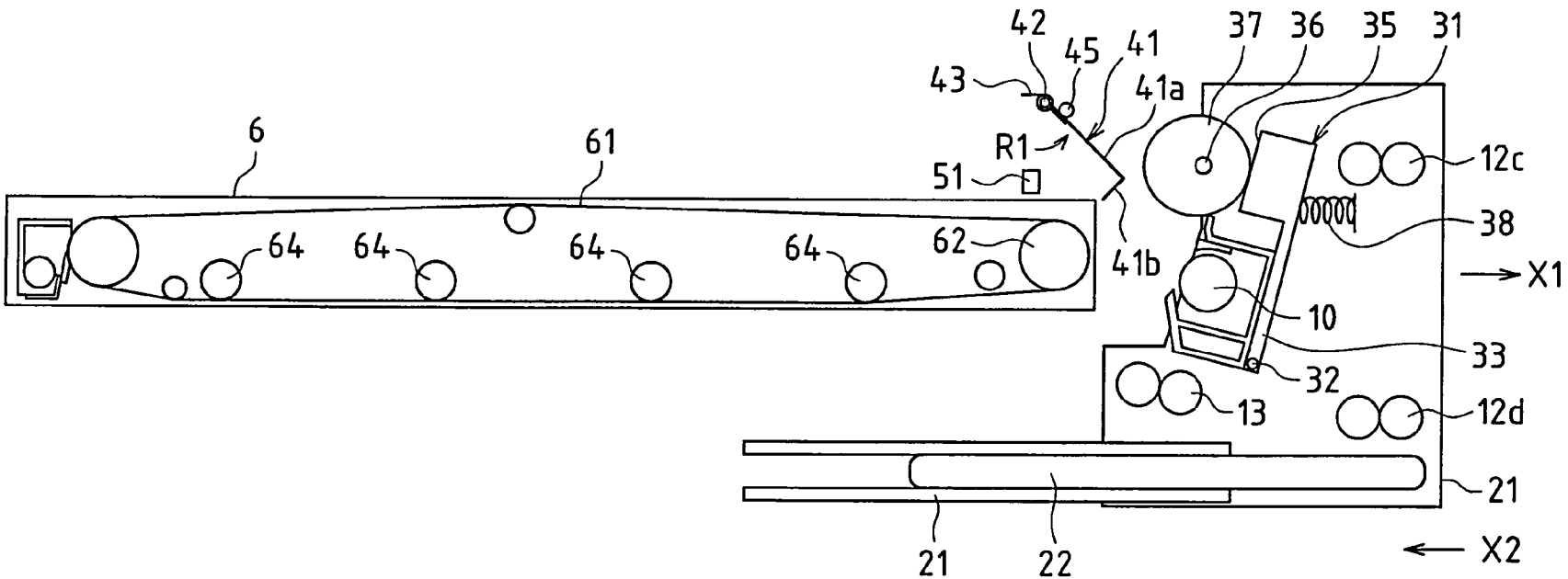
FIG. 4 is a side view illustrating the structure in the vicinity of an intermediate transfer belt unit that is a characteristic portion of the present invention.

Furthermore, a shutter regulating member (regulating pin) 45 that regulates the swing of the shutter 41 is provided at the apparatus frame in the proximity of the shutter supporting shaft 42. The shutter regulating member 45 is provided at a position where the swing movement of the shutter 41 based on the rotational movement of the eccentric cam 37 is not affected (that is, the swing movement by the rotation of the eccentric cam 37 is not regulated). On the other hand, when the side unit 21 is drawn out from the apparatus main body in the direction of X1 to detach the intermediate transfer belt unit 6, as shown in FIG. 4, the eccentric cam 37 also moves along with the side unit 21 in the direction of X1, and the shutter 41 swings in the direction of R1 due to the biasing force of the torsion coil spring 43 and is brought into contact with the shutter regulating member 45, thereby achieving the regulation of the swing movement. At this time, the shutter 41 (to be more precise, the tip end portion of the horizontal face 41*b* of the shutter 41) is furthest from the intermediate transfer belt 61. This regulated position is set so that the vertical face 41*a* of the shutter 41 is swung to a position where the vertical face 41*a* is brought into contact again with the cam face of the eccentric cam 37 to protect the detection face of the optical sensor 51 (the position as shown in FIG. 2) when the side unit 21 is pushed in for an attachment in the apparatus main body in the direction of X2 after attaching the intermediate transfer belt unit 6.

In the above-described configuration, under a normal operation mode of the image forming apparatus 100 (image forming operation), the transfer roller 10, the eccentric cam 37, and the shutter 41 are positioned in a relation as shown in FIG. 2. That is, the cam contact face 35 of the rotating plate 33 is in contact with a cam face where the distance from the cam center of the eccentric cam 37 is the nearest, and the transfer roller 10 is disposed so as to be brought into contact with the intermediate transfer belt 61 with a predetermined nip pressure. The vertical face 41*a* of the shutter 41 is brought into contact with a cam face where the distance from the cam center of the eccentric cam 37 is the furthest, and the horizontal face 41*b* is interposed between the optical sensor 51 and the intermediate transfer belt 61 to protect the detection face of the optical sensor 51 (that is, the shutter is closed). In this way, paper dust and the like of the sheet (recording paper) passing between the intermediate transfer belt 61 and the transfer roller 10 can be prevented from being attached to the detection face of the optical sensor 51.

Meanwhile, when controlling the driving current of the optical sensor 51 to adjust the irradiation light amount to a constant amount (at the time when reading a toner pattern), from the state shown in FIG. 2, the eccentric cam 37 is rotated 180 degrees by a driving means (not shown) in one direction (any one of the right direction and the left direction). By this rotation, as shown in FIG. 3, the cam contact face 35 of the rotating plate 33 is brought into contact with a cam face where the distance from the cam center of the eccentric cam 37 is the furthest, and as a result of the swing of the rotating plate 33 in the direction of X1 by the amount of eccentricity of the eccentric cam 37, the transfer roller 10 is separated from the intermediate transfer belt 61. Furthermore, the vertical face 41*a* of the shutter 41 is brought into contact with a cam face where the distance from the cam center of the eccentric cam 37 is the nearest, and the horizontal face 41*b* swings in the direction of R1 by the amount of eccentricity of the eccentric cam 37, thereby evacuating from the detection face of the optical sensor 51. That is, the shutter 41 is opened. In this way, the reference toner image (toner pattern) 68 formed on the intermediate transfer belt 61 (ref. FIG. 5) reaches right under (in front of the optical sensor) the optical sensor 51 without friction from contact with the transfer roller 10, and therefore the optical sensor 51 can detect a correct density.

Meanwhile, when, for example, replacing the intermediate transfer belt unit 6, as shown in FIG. 4, the side unit 21 is drawn out from the apparatus main body in the direction of X1. In this way, because the eccentric cam 37 moves in the direction of X1 along with the side unit 21, the shutter 41 swings in the direction of R1 due to the biasing force of the torsion coil spring 43, thereby being brought into contact with the shutter regulating member 45. Thus, the shutter 41 is widely opened, and the shutter 41 (more precisely, the tip end portion of the horizontal face 41*b* of the shutter 41) is furthest from the intermediate transfer belt 61. Furthermore, by drawing out the side unit 21 from the apparatus main body in the direction of X1, the transfer roller 10 is also significantly separated from the intermediate transfer belt 61. Therefore, when moving the intermediate transfer belt unit 6 toward the front side of the apparatus (front side in a direction perpendicular to the paper face in FIG. 4) for a detachment, or when moving the unit 6 toward the rear side of the apparatus for attachment, the shutter 41 can be prevented from colliding (making contact) with the surface of the intermediate transfer belt 61 and damaging the intermediate transfer belt 61.

At this time, by drawing the side unit 21 from the apparatus main body in the direction of X1, even if the contact between the shutter 41 and the eccentric cam 37 is lost, after moving a predetermined distance, the shutter 41 stops due to being brought into contact with the regulating pin 45, and therefore when the side unit 21 is attached to the apparatus main body again, the cam face of the eccentric cam 37 and the shutter 41 (to be precise, the vertical face 41*a*) can be reliably brought into contact, and the shutter 41 can be restored to the closed position.

In the following, a light amount adjustment of the optical sensor 51 itself is described.

Figure 5A:
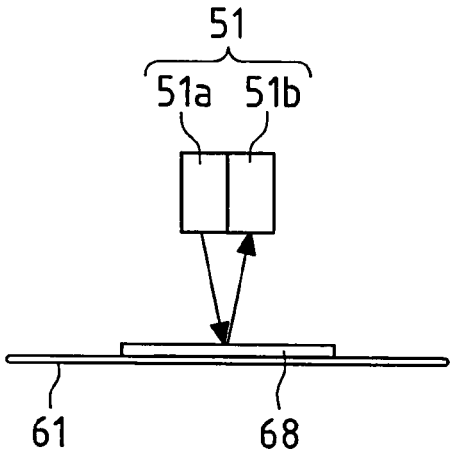
FIG. 5A is a diagram illustrating a state in the proximity of an optical sensor with a shutter opened.
Figure 5B:
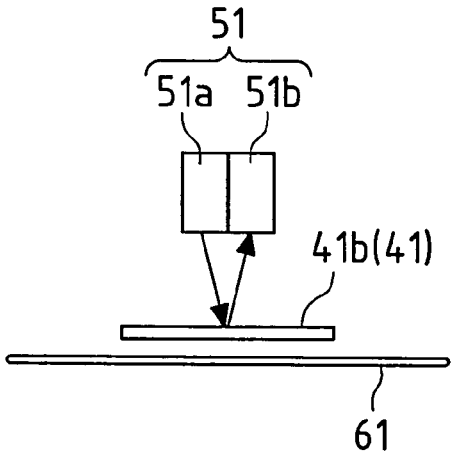
FIG. 5B is a diagram illustrating a state in the proximity of an optical sensor with a shutter closed.

FIG. 5A illustrates a state in the proximity of the optical sensor 51 with the shutter 41 opened, and FIG. 5B illustrates a state in the proximity of the optical sensor 51 with the shutter 41 closed.

The optical sensor 51 is provided with an LED 51*a*, i.e., a light-emitting element, and a photo transistor 51*b*, i.e., a light-receiving element, and the density, to be used for controlling the processing, is detected by allowing infrared light from the LED 51*a* to reflect on the toner pattern 68 on the intermediate transfer belt 61 and detecting the light with the photo transistor 51*b* (ref. FIG. 5A). However, in the LED 51*a*, due to non-uniformity of the components and deterioration over time, the amount of light emission may change even if the LED is driven by a predetermined electric current. Therefore, as shown in FIG. 5B, light is emitted from the LED 51*a* with the shutter 41 closed; reflected light from the horizontal face 41*b* of the shutter 41 is detected as a reference reflected light with the photo transistor 51*b*; and the driving current is corrected for a predetermined output. By using the shutter 41 in this way as a substrate for a light amount adjustment as well, it is not necessary to separately provide a member specialized for the light amount adjustment, achieving a simple structure.

In this case, the horizontal face 41*b* of the shutter 41 is preferably provided in close proximity to the intermediate transfer belt 61. By providing the horizontal face 41*b* in close proximity to the intermediate transfer belt 61, the distance becomes short for the optical sensor 51 to read the density of the toner pattern 68 on the intermediate transfer belt 61, and for the optical sensor 51 to read the density of the horizontal face (the horizontal face at the facing side) 41*b* of the shutter 41, and therefore a more accurate light amount adjustment can be carried out.

Figure 6:
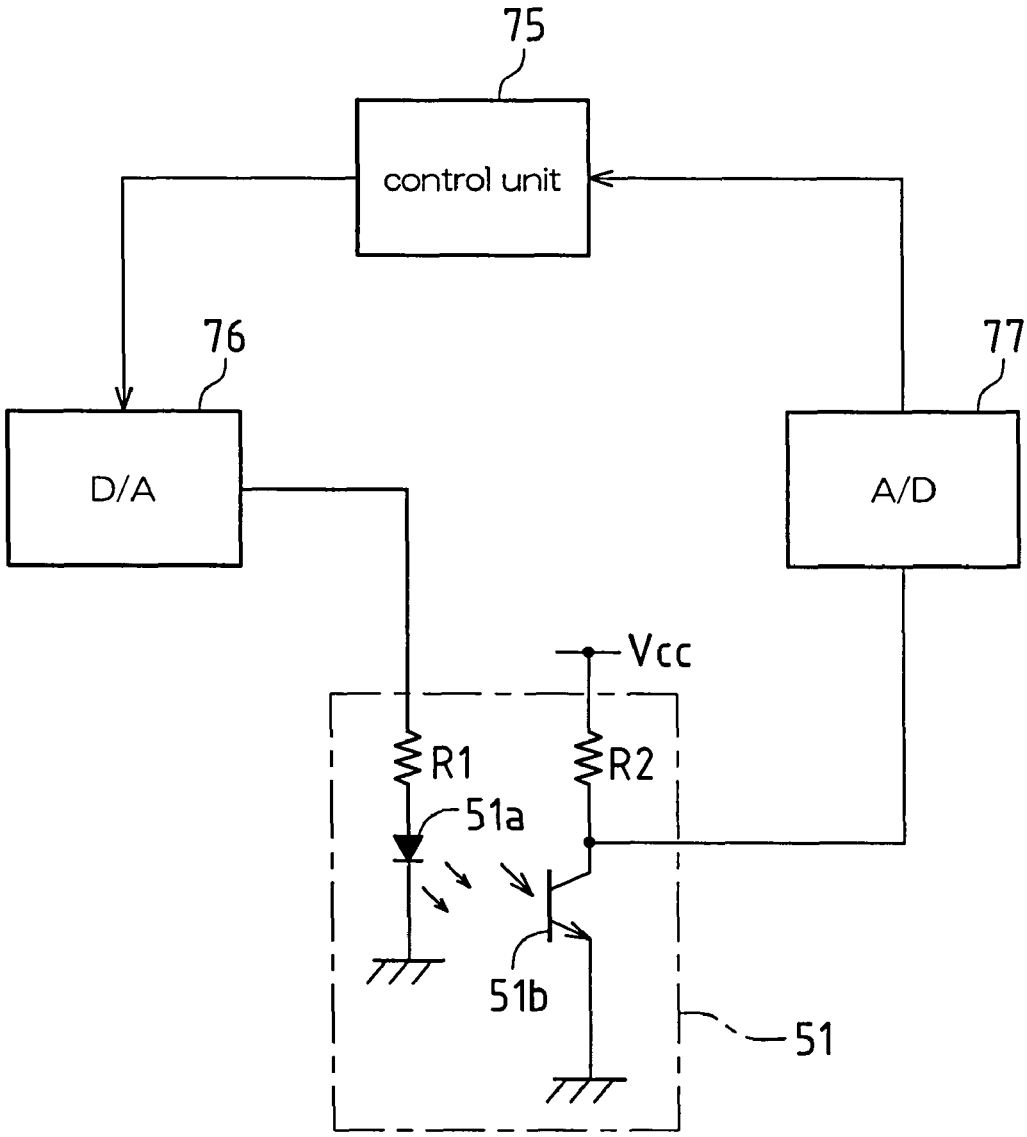
FIG. 6 is a diagram of a circuit configuration in the vicinity of an optical sensor.

FIG. 6 illustrates a circuit configuration in the vicinity of an optical sensor 51.

A control unit 75 configured of a CPU, a ROM, a RAM, and the like, which are not shown, is connected to the LED 51*a* of the optical sensor 51 via a D/A converter 76, and is connected to the photo transistor 51*b* of the optical sensor 51 via an A/D converter 77. That is, a cathode of the LED 51*a* is connected to an earth potential, and an anode of the LED 51*a* is connected to the D/A converter 76 via a resistor R1. Furthermore, in the photo transistor 51*b*, an emitter is connected to an earth potential, and a collector is connected to a power source voltage Vcc via a resistor R2 and to the A/D converter 77. The A/D converter 77 converts an analog output of the photo transistor 51*b* to a digital value. The control unit 75 controls the D/A converter 76 based on the digital value from the A/D converter 77, i.e., an output of the photo transistor 51*b*, thereby adjusting the light emission amount of the LED 51*a*.

Figure 7A:
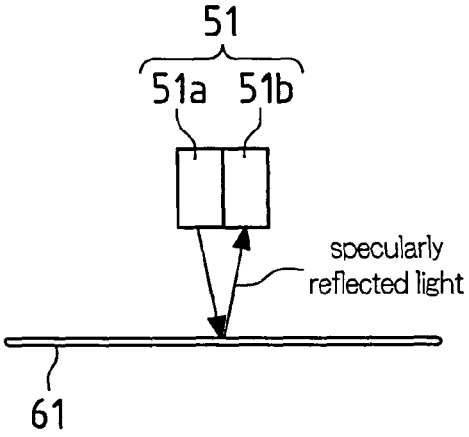
FIG. 7A is a diagram illustrating a case where an optical sensor is used for detecting movement of a secondary transfer unit.
Figure 7B:
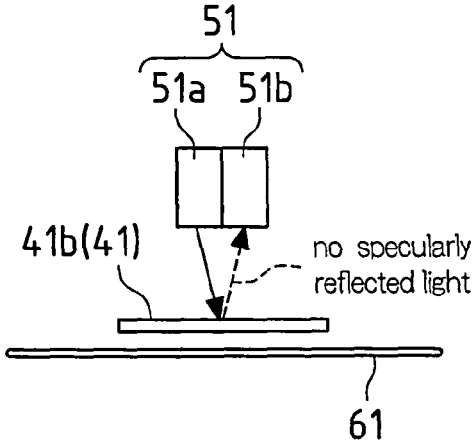
FIG. 7B is a diagram illustrating a case where an optical sensor is used for detecting movement of a secondary transfer unit.

Although the shutter 41 is used for adjusting a light amount of the optical sensor 51 itself in the method described above, in another possible configuration, an output of the optical sensor 51 may be used to detect the movement of the secondary transfer unit 31 (to be precise, movement of the side unit 21). In this case, at least the horizontal face 41*b* of the shutter 41 facing the optical sensor 51 is configured so as not to reflect light. In this way, as shown in FIG. 7A and FIG. 7B, as long as the shutter 41 is closed (a state shown in FIG. 7B), there is no specularly reflected light to the optical sensor 51, and as long as the shutter 41 is opened (a state shown in FIG. 7A), light specularly reflected from the transfer belt 61 reaches the photo transistor 51*b* of the optical sensor 51. Therefore, an output of the optical sensor 51 can be used to detect whether or not the shutter 41 is reliably opened and closed along with the movement of the secondary transfer unit 31 (precisely, the side unit 21). In this way, it is not necessary to separately provide a sensor specialized for detecting whether or not the secondary transfer unit 31 is drawn out, thereby achieving a decrease in the number of the components and a reduction in the size of the apparatus.

The control unit 75 controls whether or not a printing operation is possible based on the output of the optical sensor 51 for detecting whether or not the secondary transfer unit 31 is drawn out or not. When the secondary transfer unit 31 is drawn out, the control unit 75 allows a display of an operation panel (not shown) to show that the secondary transfer unit 31 is drawn out, and forbids the printing operation.

Figure 8:
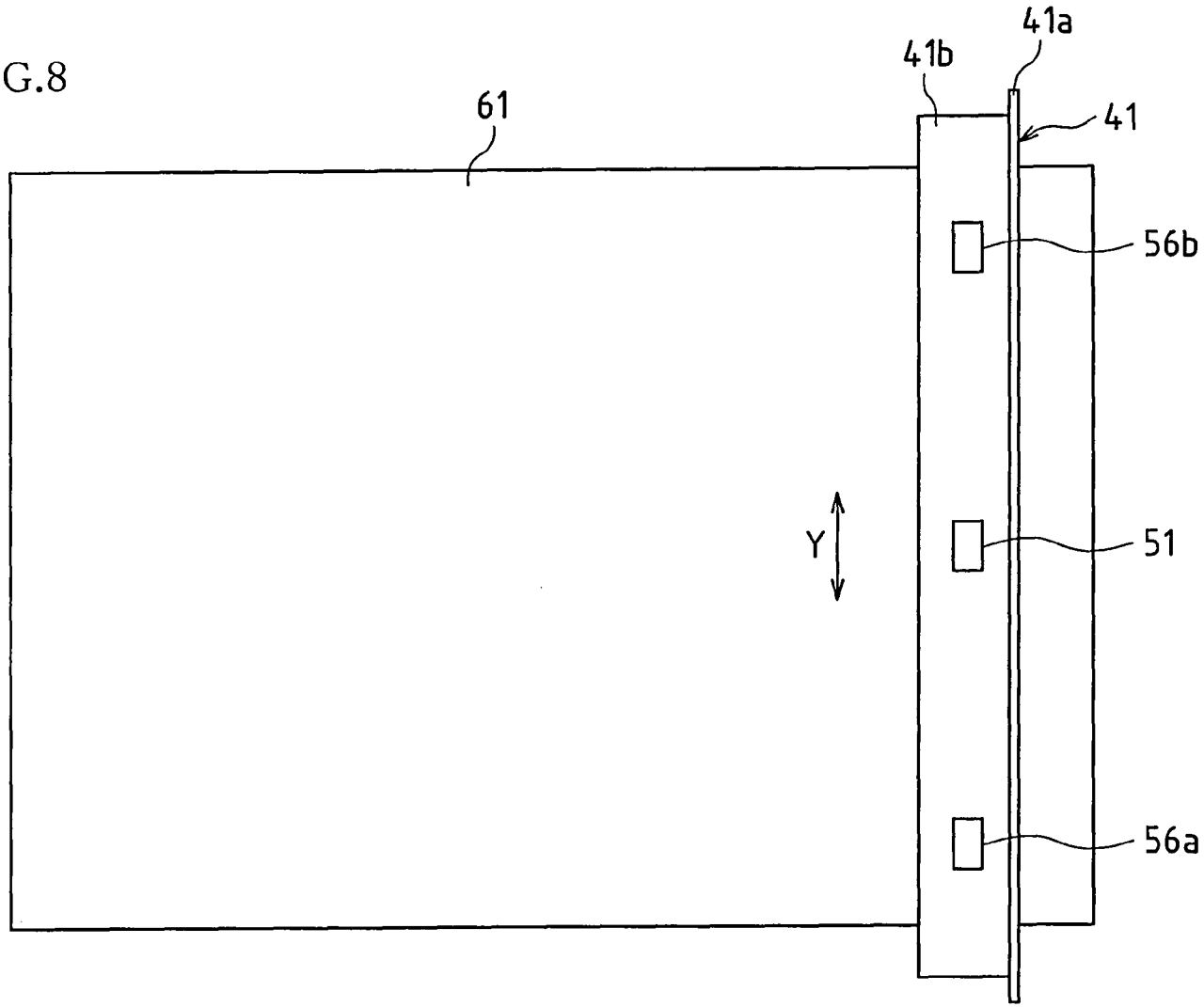
FIG. 8 is a plan view illustrating the position of an optical sensor and registration sensors with respect to an intermediate transfer belt, seen from above the apparatus.
Figure 9:
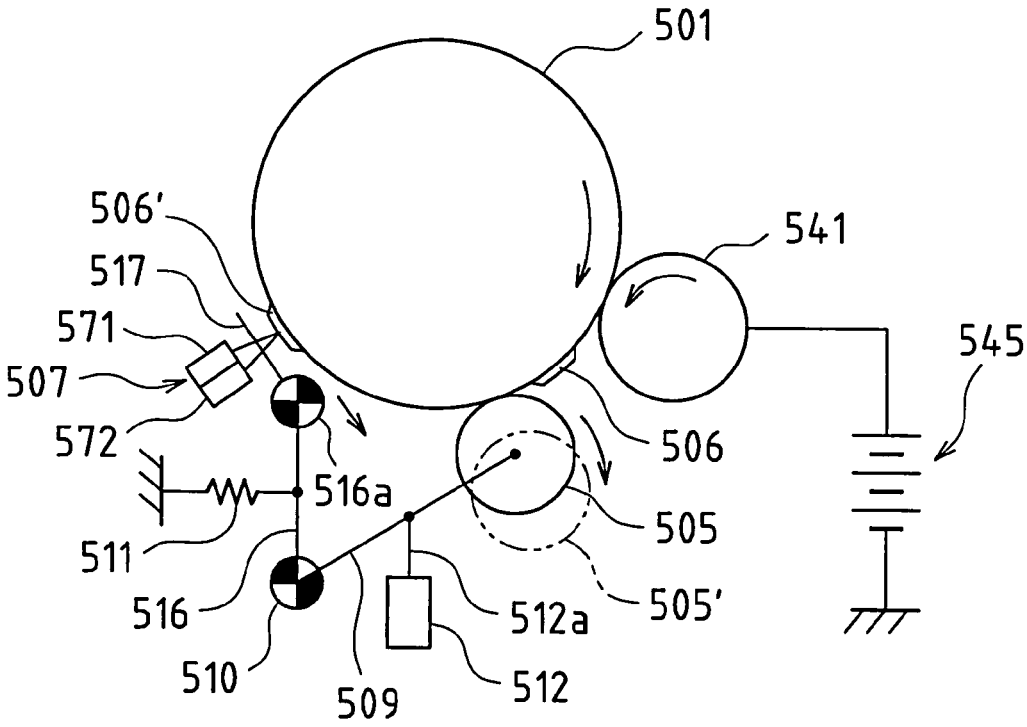
FIG.9 Prior Art
FIG. 9 is a schematic cross-sectional view of a conventional image forming apparatus provided with a shutter in front of the optical sensor.

FIG. 8 is a plan view illustrating the position of the optical sensor 51 and the registration sensors 56*a* and 56*b* with respect to the intermediate transfer belt 61, seen from above the apparatus.

The registration sensors 56*a* and 56*b* are for correcting the position of image formation by detecting a registration mark, i.e., reference pattern, and are provided as a pair, at a front side and a rear side of the apparatus. The optical sensor 51 is provided at the center between the registration sensors. That is, the optical sensor 51 and the registration sensors 56*a* and 56*b* are disposed in a row in main scanning directions Y, and in this embodiment, the shutter 41 of the optical sensor 51 also functions as the shutter of the registration sensors 56*a* and 56*b*. That is, the shutter 41 functions commonly to close/open their respective detection faces. In this way, one set of a shutter and an open/close mechanism will suffice, and an increase in the number of the components can be suppressed.

The present invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes that come within the meaning and range of equivalency of the claims are intended to be embraced therein.

What is claimed is:

1. An intermediate transfer-type image forming apparatus comprising:

a transfer belt unit that is attachable to and detachable from the image forming apparatus and that has a transfer belt that primarily transfers a toner image formed on a photosensitive drum;

a secondary transfer unit having a transfer mechanism portion that secondarily transfers the primarily transferred toner image to a paper;

a side unit that is equipped with the secondary transfer unit;

an optical sensor that detects a reference toner image on the transfer belt, the optical sensor being located downstream of the secondary transfer unit; and a shutter that protects a detection face of the optical sensor, wherein a separation/contact mechanism portion that is disposed so as to be brought into contact with both of the shutter and the secondary transfer unit is provided, and the separation/contact mechanism portion allows the shutter to move so as to open and allows the secondary transfer unit to move so as to separate from the transfer belt when the reference toner image is detected by the optical sensor, and allows the shutter to move to a location away from the transfer belt when the side unit equipped with the secondary transfer unit is drawn out from an apparatus main body to attach or detach the transfer belt unit.

2. The intermediate transfer-type image forming apparatus according to claim 1, wherein movement of the secondary transfer unit is detected by using output of the optical sensor.

3. The intermediate transfer-type image forming apparatus according to claim 1, wherein the separation/contact mechanism portion comprises an eccentric cam provided with a cam face that is brought into contact with both of the shutter and the secondary transfer unit.

4. The intermediate transfer-type image forming apparatus according to claim 3, wherein the separation/contact mechanism portion comprises a shutter bias portion that biases the shutter in a direction that the shutter opens.

5. The intermediate transfer-type image forming apparatus according to claim 3, wherein the separation/contact mechanism portion comprises a unit bias portion that biases a transfer roller in a direction that the secondary transfer unit is pressed against the transfer belt.

6. The intermediate transfer-type image forming apparatus according to claim 1, wherein the optical sensor is a reflective optical sensor comprising a light-emitting element and a light-receiving element, and is provided with a control unit that carries out a light amount adjustment based on a light receiving amount obtained by allowing the light-emitting element to emit light while the shutter is protecting the detection face of the optical sensor and receiving reflected light at a reverse side of the shutter by the light-receiving element.

7. The intermediate transfer-type image forming apparatus according to claim 6, wherein the shutter is provided in a close proximity to the transfer belt when the shutter is closed so as to protect the detection face of the optical sensor.

8. The intermediate transfer-type image forming apparatus according to claim 4, wherein a regulating portion that regulates movement of the shutter by the shutter bias portion to a predetermined distance when the secondary transfer unit is drawn out from the apparatus main body is provided.

9. The intermediate transfer-type image forming apparatus according to claim 1, wherein registration sensors that detect a registration mark of a reference pattern are disposed with the optical sensor in a row along a main scanning direction, and opening and closing of the registration sensors and the optical sensor are commonly controlled by the shutter.

* * * * *